US007798094B2

(12) United States Patent
Meissner

(10) Patent No.: US 7,798,094 B2
(45) Date of Patent: Sep. 21, 2010

(54) COATING INSTALLATION AND ASSOCIATED OPERATING PROCEDURE

(75) Inventor: Alexander Meissner, Stuttgart (DE)

(73) Assignee: Durr Systems, Inc., Auburn Hills, MI (US)

( * ) Notice: Subject to any disclaimer, the term of this patent is extended or adjusted under 35 U.S.C. 154(b) by 945 days.

(21) Appl. No.: 11/159,715

(22) Filed: Jun. 23, 2005

(65) Prior Publication Data

US 2006/0040060 A1 Feb. 23, 2006

(30) Foreign Application Priority Data

Jun. 25, 2004 (DE) ..... 10 2004 030 858

(51) Int. Cl.

| | |
|---|---|
| ***B05C 5/00*** | (2006.01) |
| ***B05C 11/10*** | (2006.01) |
| *B05B 13/04* | (2006.01) |
| *B05B 13/02* | (2006.01) |

(52) U.S. Cl. ..... 118/305; 118/300; 118/313; 118/314; 118/500; 118/676; 427/289; 427/427.3

(58) Field of Classification Search ..... 427/427.3, 427/289; 118/500, 305, 313

See application file for complete search history.

(56) References Cited

FOREIGN PATENT DOCUMENTS

| | | | |
|---|---|---|---|
| DE | 10 2004 030 858 | | 6/2004 |
| EP | 192 338 | | 8/1986 |
| EP | 192338 | A1 * | 8/1986 |
| FR | 2 806 012 | | 3/2000 |
| JP | 01-266870 | | 10/1989 |
| WO | WO-01/68267 | | 9/2001 |
| WO | WO 0168267 | A1 * | 9/2001 |
| WO | WO 2004/037430 | | 5/2004 |

* cited by examiner

*Primary Examiner*—Michael Kornakov
*Assistant Examiner*—Alexander Weddle
(74) *Attorney, Agent, or Firm*—Rader Fishman Grauer

(57) ABSTRACT

Coating installation, specifically for painting automobile body parts, having at least two application robots (3, 5) for applying a coating means to a target, at least two handling robots (4. 6) for handling the target and two linear guides (1, 2) along which the handling robots (4. 6) and the application robots (3, 5) can be driven. It is proposed that each of the two linear guides (1, 2) carries at least one of the application robots (3, 5) and at least one of the handling robots (4. 6).

10 Claims, 5 Drawing Sheets

COATING INSTALLATION AND ASSOCIATED OPERATING PROCEDURE

CLAIM FOR PRIORITY TO FOREIGN APPLICATION

Figure 1:
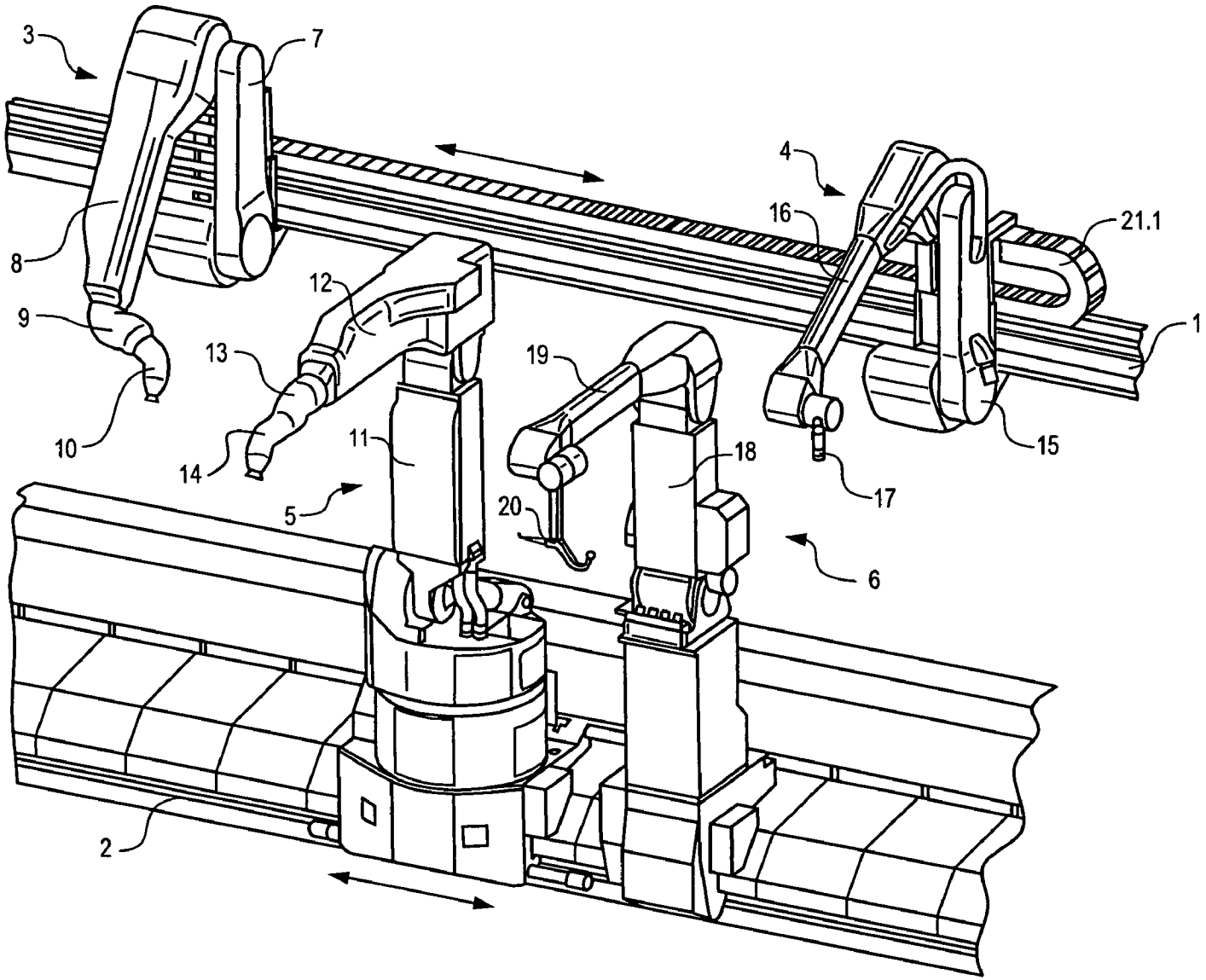

This is an application claiming priority to German Application Serial No. 10 2004 03 0858.6, filed Jun. 25, 2004, the contents of which are hereby incorporated by reference in their entirety.

The invention relates to a coating installation, specifically for painting automobile body parts, in accordance with claim 1 and an associated operating method in accordance with claim 9.

A painting installation is known from WO 01/68267 A1 for painting automobile body parts in which the automobile body parts are conveyed in succession on a paint line through several paint zones which are situated one following the other. Two linear guides are located one above the other on both sides of the paint line, where the upper guide carries several handling robots (e.g. hood openers or door openers) moveable in the longitudinal direction of the guide, while the lower guide carries several application robots moveable in the longitudinal direction of the guide.

The advantage of this known painting installation is that the handling robots and the application robots can be positioned in the longitudinal direction without mutual interference since the two different types of robots are assigned to one of the two linear guides.

The disadvantage of this known painting installation with a separate guide for the application robots on the one hand and the handling robots on the other, is that a disruption of the ability to move an application robot or handling robot and the resulting shutdown of the particular application or handling robot severely restricts the handling or application capability of the affected paint cell, since the application or handling robot which broke down blocks adjacent robots of the same type (application or handling robot) so that they cannot compensate for the disruption.

The object of the invention is therefore to increase the immunity to breakdowns of the known paint installation described initially.

This object is accomplished by the features of the independent claims.

The invention embraces the general technical teaching of not locating the application robots and the handling robots (e.g. hood openers or door openers) on the same linear guide. This is done in order to avoid blocking the other still functional robots of the same type, in the event that one handling or application robot fails, and thereby preventing the still functional robots in adjacent paint cells from assuming the function of the incapacitated robot. Instead, the invention provides for each of the linear guides to carry both application and handling robots so that if an application or handling robot on one linear guides breaks down, the potential exists for an application or handling robot on the other linear guide to assume the function of the incapacitated robot so that the coating installation in accordance with the invention can tolerate malfunctions.

In a coating installation with two linear guides, each of the two linear guides preferably carries at least one of the application robots and at least one of the handling robots.

Preferably the coating installation in accordance with the invention has two linear guides which can be located on one side or both sides of the paint line, where the linear guides are preferably located one above the other and preferably run parallel to each other.

The term application robot used within the scope of the invention is to be understood generally and is not restricted to multi-axis robots in the narrower sense. Rather the term application robot within the scope of the invention includes devices without several movable axes which permit automated application of a coating medium. In the case of the application robot within the scope of the invention, it is preferably a multi-axis robot having a highly movable robot wrist which carries, for example, a rotary atomizer as the application equipment.

In the case of the handling robot, it can be, for example, an intrinsically known hood opener or a similarly known door opener, but the invention is not limited to such embodiments for the handling robot.

It should further be mentioned that the invention is not limited to paint installations but includes coating installations in general in which a coating medium (e.g. primer, primer-surfacer, basecoat, clearcoat, protective shipping wax) is applied.

As a result of the arrangement of the application robots and the handling robots in which they are distributed on the different linear guides, a stoppage caused by a malfunction in an application robot does not result in blocking all the similar robots of the same type since the application or handling robots carried on the other linear guide are not affected by the breakdown. The advantageous possibility exists that the breakdown of one robot on one linear guide is compensated by a fully functional robot of the same type on the other linear guide.

Preferably the application or handling robots on one linear guide can pass move past the application or handling robots on the other linear guide in the longitudinal direction. This offers the advantage that a malfunction-induced stoppage of a robot on one linear guide does not hamper the movement of the robots on the other linear guide.

In a preferred embodiment of the invention, handling robots and application robots are located alternately one after the other in the longitudinal direction on the individual linear guides. This offers the advantage that when one robot breaks down, the average distance to the next robot of the same type on the other linear guide is minimal.

The coating installation in accordance with the invention preferably has several coating zones located one after the other through which the linear guides run, where at least one handling robot and at least one application robot is located in the individual coating zones. If a handling robot or application robot experiences a functional failure in a coating zone, a robot of the same type from an adjacent coating zone can be summoned to assist in order to compensate for the functional failure.

In the individual coating zones, the handling robot is preferably installed on one linear guide, while the application robot is carried on the other linear guide, where the assignment of handling robot and application robot to the linear guides can switch between the individual coating cells.

The alternative possibility also exists that the handling robot and the application robot are located on the same linear guide, where the particular linear guide switches from coating zone to coating zone. For example, there is the possibility that the handling robot and the application robot are located on the upper linear guide in one coating zone, while the handling robot and the application robot are located on the lower linear guide in the adjacent coating zone.

In addition, the invention includes an operating method for the coating installation in accordance with the invention, in which at least one of the application robots and at least one of the handling robots is carried on the individual linear guides of the coating installation to enable them to tolerate malfunctions as previously described.

Other advantageous refinements are identified in the dependent claims or are explained in greater detail in what follows along with the description of the preferred embodiments of the invention with reference to the drawings.

Figure 2:
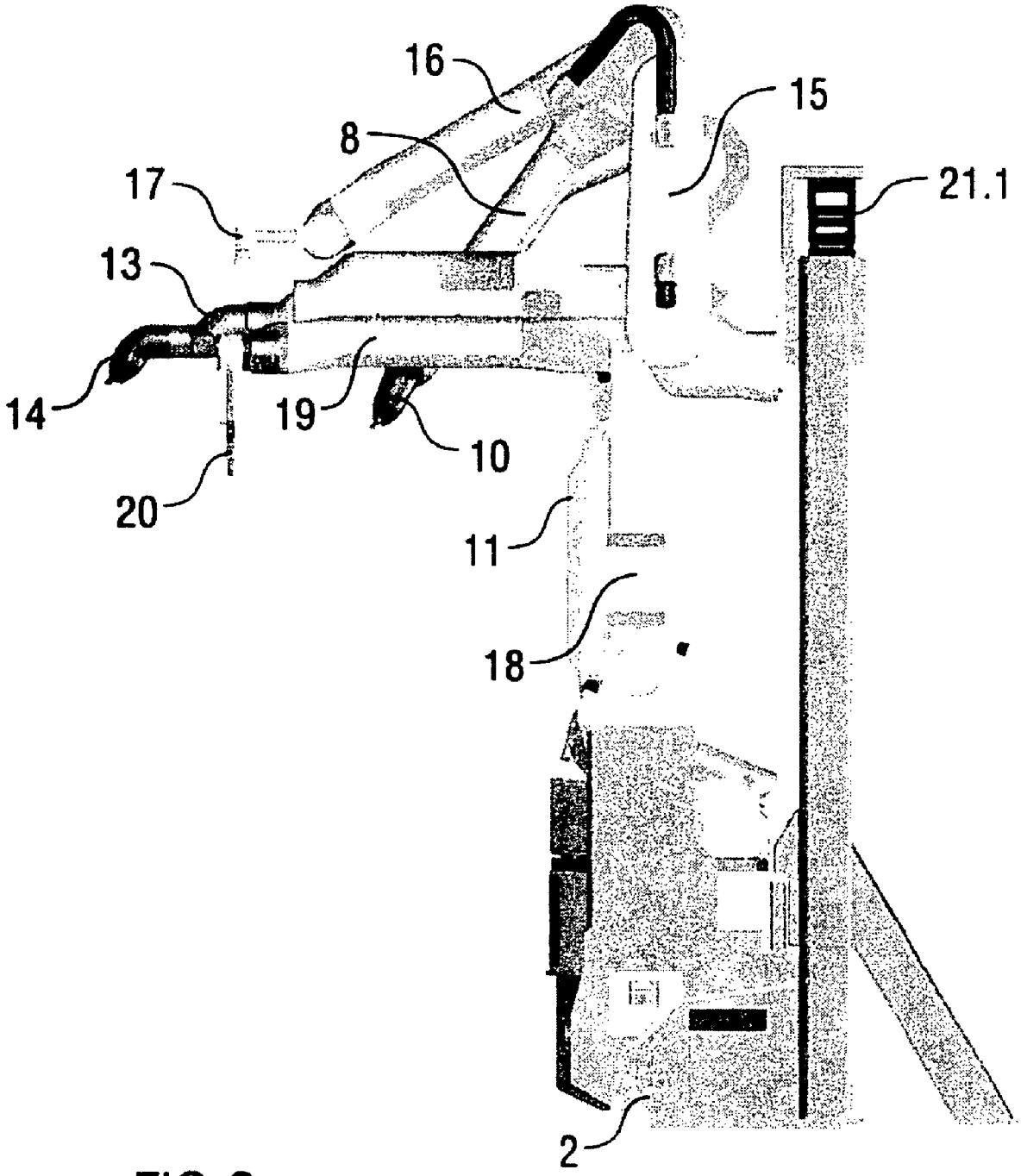
Figure 3:
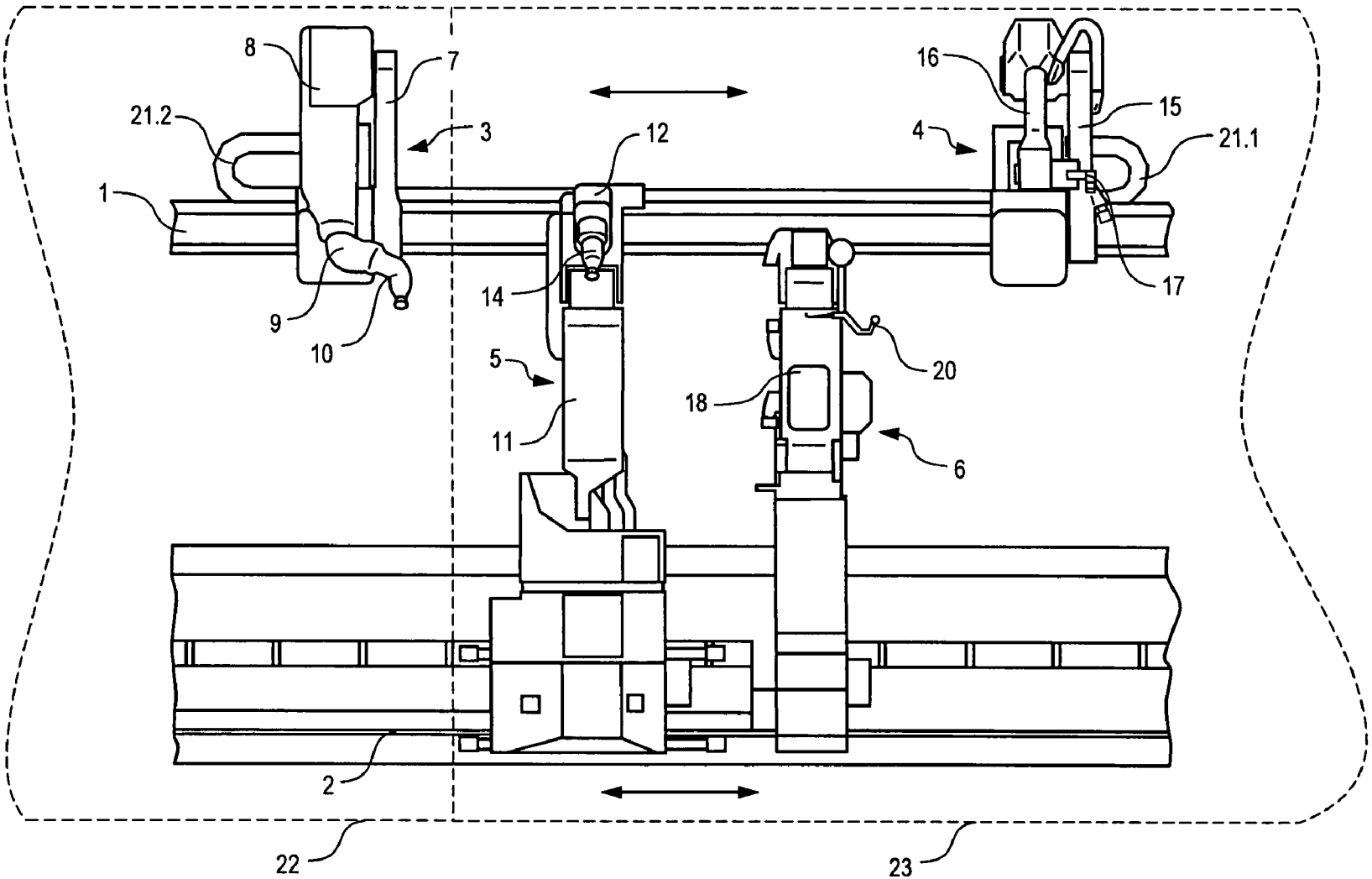
Figure 4A:
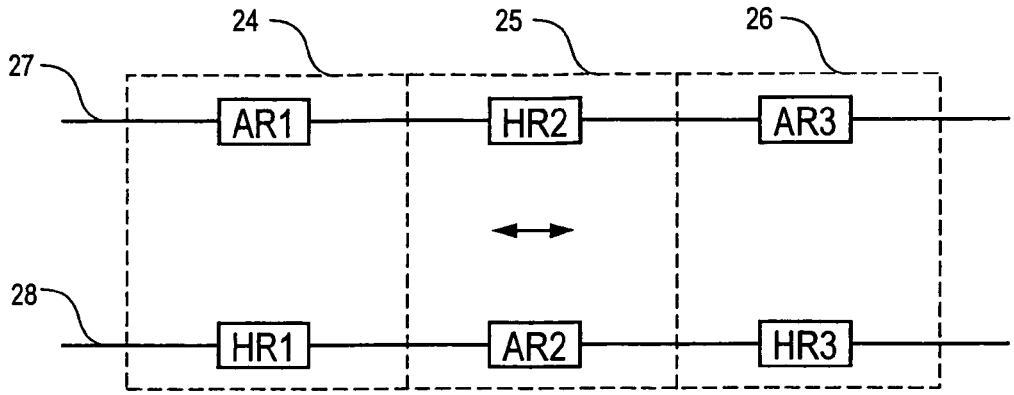
Figure 4B:
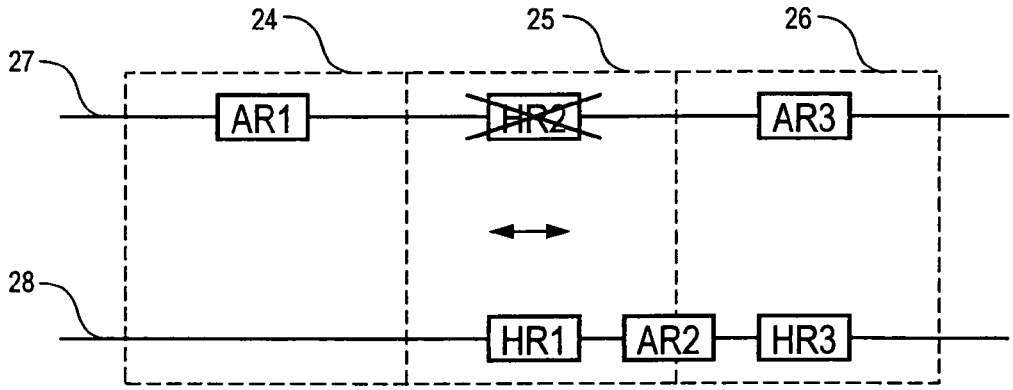
Figure 4C:
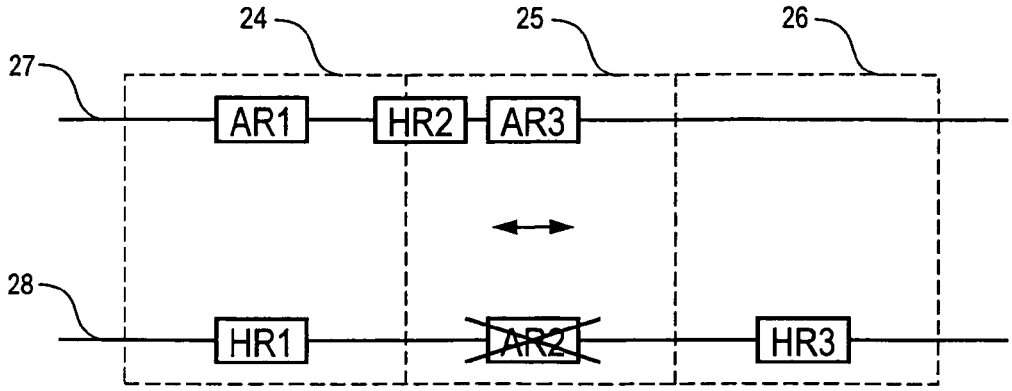
Figure 5A:
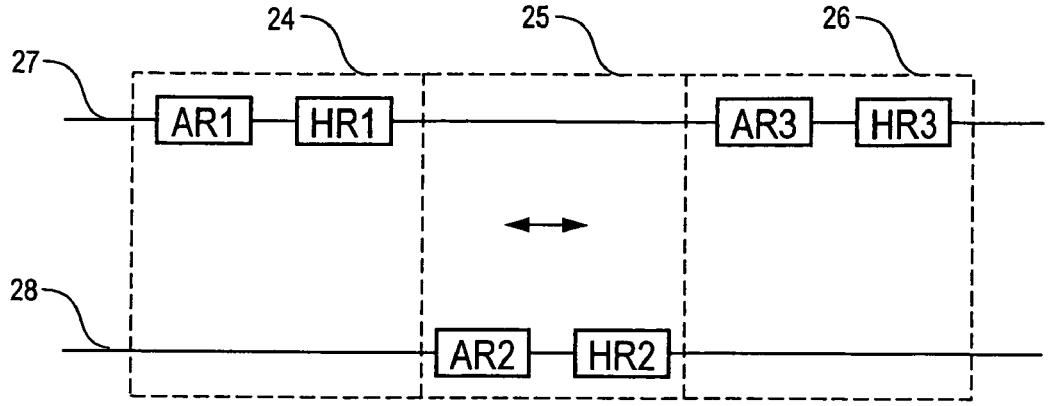
Figure 5B:
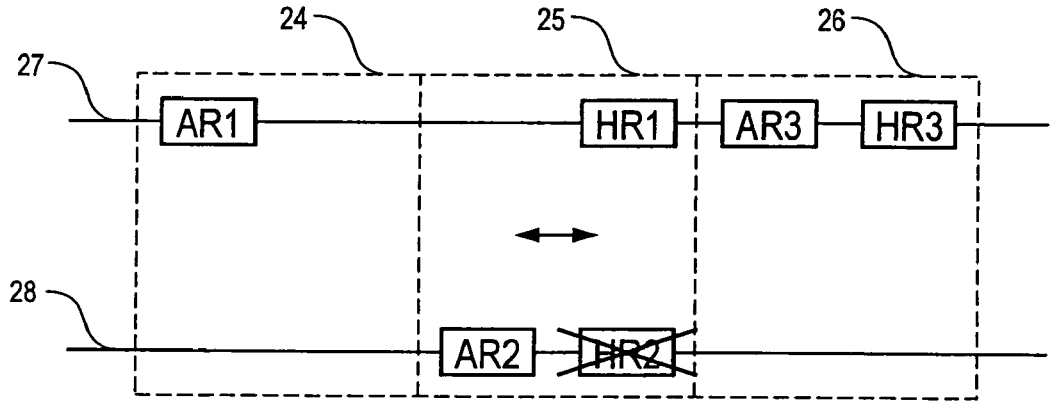
Figure 5C:
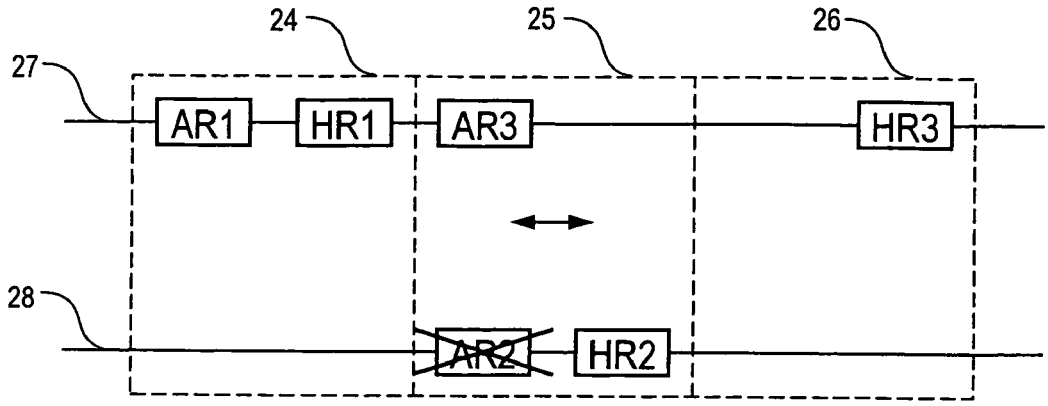

FIG. 1 shows a perspective view of a paint installation in accordance with the invention on one side of a paint line, FIG. 2 shows a front elevation of the paint installation from FIG. 1, FIG. 3 shows a plan view of the paint installation from FIG. 1, FIGS. 4*a*-4*c* show schematics of a coating installation in accordance with the invention during error-free operation or when a robot breaks down, FIGS. 5*a*-5*c* show additional schematics of a coating installation in accordance with the invention during error-free operation or when a robot breaks down.

The perspective views in FIGS. 1 to 3 show a paint installation in accordance with the invention on one side of a paint line, where the paint line itself and the opposite side of the paint line are not shown for the sake of simplicity.

The paint installation has two linear guides 1, 2 located opposite and running parallel to each other, where the upper linear guide 1 carries a painting robot 3 and a handling robot 4 which can be moved in the direction of the arrow.

The painting robot 3 is of largely conventional construction and has several robot arms 7, 8 and a robot wrist axis 9 which carries a rotary atomizer 10.

The painting robot 5 is also of largely conventional construction and has several robot arms 11, 12 and a robot wrist axis which carries a rotary atomizer 14.

The handling robot 4 is a largely conventionally constructed door opener which opens the car doors on unpainted car bodies for the painting process. The handling robot 4 has several robot arms 15, 16 and a pivotable gripper. In addition, the handling robot 4 has a wrist axis which is of single-axis design.

The handling robot 6, on the other hand, is a largely conventionally constructed hood opener which opens a hood or trunk lid on an unpainted car body during the painting process. The handling robot 6 has several robot arms 18, 19 for this purpose and a suitably modified gripper 20. The handling robot 6 additionally has a wrist axis which is of single-axis design.

The painting robot 3 and the handling robot 4 on the upper linear guide 1 are supplied with power through two separate feed lines 22.1, 22.2, where only line 21.1 is shown in FIG. 1. The painting robot 3 and the handling robot 4 are movable in the direction of the arrow.

The painting robot 5 and the handling robot 6 are also moveable on the lower linear guide in the direction of the arrow. In the event of a breakdown of painting robot 5 or painting robot 6, this allows the other painting robot 3 or 5 respectively take over from the malfunctioning painting robot 3 or 5, whereby the paint installation in accordance with the invention is more tolerant of malfunctions.

It can be seen further from FIG. 3 that the paint installation in accordance with the invention has several paint zones located one after the other in the longitudinal direction of the two linear guides 1, 2, only two paint zones 22, 23 being shown for the sake of simplicity. In the event that painting robot 3 breaks down in paint zone 22, painting robot 5 can be summoned from paint zone 23 to assist. Painting robot 5 is then driven from paint zone 23 in the direction of the arrow into paint zone 22 to the place of the defective painting robot 3, where it temporarily assumes the latter's function. In this way failures can be compensated for across paint zones, thereby creating a breakdown-tolerant system.

FIGS. 4*a* through 4*c* show schematics for of a coating facility in accordance with the invention, having several coating zones 24, 25, 26 through which two linear guides 27, 28 which are located above one another run in parallel.

The upper linear guide 27 carries alternately an application robot AR1, a handling robot HR2 and an application robot AR3, while the lower linear guide 28 carries alternately a handling robot HR1, an application robot AR2 and a handling robot HR3 in the direction of the arrow.

When operation is proceeding without malfunctions, as shown in FIG. 4*a*, one application robot AR1, AR2 or AR3 and one handling robot HR1, HR2 or HR3 is located in each of the coating zones 24-26, acting together in pairs in each instance.

FIG. 4*b*, on the other hand, shows a malfunction situation in which handling robot HR2 in coating zone 25 has broken down and can no longer be moved in the direction of the arrow. In a malfunction situation of this kind, handling robot HR1 is driven from coating zone 24 into coating zone 25 having the defective handling robot HR2 and temporarily assumes its functions there.

FIG. 4*c*, on the other hand, shows a malfunction situation in which application robot AR2 from coating zone 25 has broken down and can no longer be driven in the direction of the arrow. In this malfunction situation, application robot AR3 is driven from coating zone 26 into coating zone 25 having the defective painting robot AR2 and temporarily assumes its functions there.

The embodiment of a coating installation in accordance with the invention illustrated in FIGS. 5*a* to 5*c* is largely identical to the embodiment described previously and shown in FIGS. 4*a* to 4*c*, so that reference is made to the previous description to avoid repetition, with the same reference numerals being used for identical components or assemblies.

One special feature of the embodiment is that in each of the coating zones 24-26 a pair of application robots AR1, AR2 or AR3 and handling robots HR1, HR2 or HR3 is located on the same linear guide. The two types of robot (handling robot or application robot) are thus located within the individual coating zones 24-26 on the same linear guide 27 or 28, where the linear guide 27 or 28 that is used switches between the individual coating zones 24-26.

The invention is not restricted to the preferred embodiments previously described. Instead, a plurality of variants and modifications is possible which also make use of the inventive idea and therefore fall within the scope of the application.

LIST OF REFERENCE NUMERALS

1, 2 Linear guides
3 Painting robot
4 Handling robot
5 Painting robot
6 Handling robot
7, 8 Robot arm
9 Robot wrist axis
10 Rotary atomizer
11, 12 Robot arms
13 Robot wrist axis
14 Rotary atomizer
15, 16 Robot arms
17 Gripper
18, 19 Robot arms

20 Gripper
21.1, 21.2 Supply line
22, 23 Painting zones
24-26 Coating zones
AR1-AR3 Application robots
HR1-HR3 Handling robots

What is claimed is

1. A coating installation, specifically for painting car body parts, comprising:

at least two application robots for applying a coating medium on a target;

at least two handling robots for handling the target;

at least two coating zones, each coating zone including at least one of the application robots and at least one of the handling robots, the coating zones each configured to apply a coating to the target;

at least two linear guides along which the handling robots and the application robots can be driven, wherein each of the two linear guides carries at least one of the application robots and at least one of the handling robots, the linear guides each extending between the at least two coating zones;

wherein the handling robots and the application robots on a first one of the linear guides are each configured to move past the handling robot and the application robot on a second one of the linear guides, respectively, in a longitudinal direction; and wherein when a malfunctioning one of the handling robots and application robots is not capable of moving along the second one of the linear guides carrying the malfunctioning robot, a compensating one of the other handling and application robots performs a function associated with the malfunctioning robot, the compensating robot carried on the first one of the linear guides.

2. The coating installation in accordance with claim 1, wherein the two linear guides are located one above the other.

3. The coating installation in accordance with claim 1, wherein the two linear guides extend substantially parallel to each other.

4. The coating installation in accordance with claim 1, wherein the handling robots are at least one of door openers or hood openers.

5. The coating installation in accordance with claim 1, wherein the linear guides run through several coating zones, and wherein at least one handling robot and at least one application robot in the individual coating zones are mounted on different linear guides.

6. The coating installation in accordance with claim 5, wherein the handling robot and at least one application robot in the individual coating zones are mounted on different linear guides.

7. The coating installation in accordance with claim 1, wherein, in a normal configuration, the application robots and the handling robots act together in pairs.

8. A coating installation system, comprising:

a first coating zone configured to apply a first coating to a target;

a second coating zone located immediately adjacent the first coating zone, the second coating zone configured to apply a second coating to the target;

a first guide extending through both the first coating zone and the second coating zone;

a second guide extending through both the first coating zone and the second coating zone;

a first application robot selectively guided along the second guide for applying a the first coating on a first portion of a the target, the first application robot selectively positioned within the first coating zone;

a second application robot selectively guided along the first guide for applying a the second coating on a second portion of the target, the second application robot selectively positioned within the second coating zone;

a first handling robot selectively guided along the first guide for handling the a first portion of the target, the first handling robot selectively positioned within the first coating zone; and a second handling robot selectively guided along the second guide for handling a second portion of the target, the second handling robot selectively positioned within the second coating zone and configured to move longitudinally past the first handling robot;

wherein in a normal configuration the first application robot and the first handling robot are positioned within the first coating zone for applying the first coating to the target, and the second application robot and the second handling robot are positioned within the second coating zone for applying the second coating to the target;

wherein in a malfunction configuration the second handling robot does not guide along the second guide, and the first handling robot selectively moves along the first guide from the first coating zone to the second coating zone for handling the second portion of the target.

9. The coating installation system of claim 8, further comprising a third coating zone located immediately adjacent the second coating zone;

a third application robot selectively guided along the second guide for applying a third coating on a third portion of the target, the third application robot selectively positioned within the third coating zone; and a third handling robot selectively guided along the first guide for handling the target, the third handling robot selectively positioned within the third coating zone.

10. The coating installation according to claim 1, wherein the handling robots and the application robots are positioned alternately along each of the two linear guides in the longitudinal direction.

* * * * *